US005244517A

United States Patent [19]

Kimura et al.

[11] Patent Number: 5,244,517

[45] Date of Patent: Sep. 14, 1993

[54] MANUFACTURING TITANIUM ALLOY COMPONENT BY BETA FORMING

[75] Inventors: Atsuyoshi Kimura, Kuwana; Sachihiro Isogawa, Nagoya; Toshihiko Matsubara, Wako, all of Japan

[73] Assignees: Daido Tokushuko Kabushiki Kaisha, Aichi; Honda Giken Kogyo Kasbushiki Kaisha, Tokyo, both of Japan

[21] Appl. No.: 775,993

[22] PCT Filed: Mar. 19, 1991

[86] PCT No.: PCT/JP91/00371

§ 371 Date: Nov. 15, 1991

§ 102(e) Date: Nov. 15, 1991

[30] Foreign Application Priority Data

Mar. 20, 1990 [JP] Japan ..... 2-71246

[51] Int. Cl.[5] ..... C22C 14/00

[52] U.S. Cl. ..... 148/670; 148/421; 148/671

[58] Field of Search ..... 148/670, 671, 421

[56] References Cited

U.S. PATENT DOCUMENTS

| | | | |
|---|---|---|---|
| 3,635,068 | 1/1972 | Watmough | 148/669 |
| 3,867,208 | 2/1975 | Grekov et al. | 148/670 |
| 4,810,465 | 3/1989 | Kimura et al. | 420/418 |
| 5,026,520 | 6/1991 | Bhowal et al. | 148/670 |
| 5,112,415 | 5/1992 | Mae | 148/421 |
| 5,124,121 | 6/1992 | Ogawa et al. | 148/669 |

FOREIGN PATENT DOCUMENTS

| | | |
|---|---|---|
| 0257445 | 11/1986 | Japan . |
| 62-284051 | 12/1987 | Japan . |
| 63-130755 | 6/1988 | Japan . |
| 63-223155 | 9/1988 | Japan . |
| 63-259058 | 10/1988 | Japan . |

*Primary Examiner*—Upendra Roy

*Attorney, Agent, or Firm*—Frishauf, Holtz, Goodman & Woodward

[57] ABSTRACT

A titanium alloy is prepared containing 2 to 4% by weight of aluminum, 1.5 to 2.5% by weight of vanadium, 0.20 to 0.45% by weight of a rare earth element (not essential). 0.05 to 0.11% by weight of sulfur (not essential), and titanium substantially for the remainder, the ratio of the rear earth element content to the sulfur content ranging from 3.8% to 4.2%. This titanium alloy is rough-formed and hot-forged at a temperature in a $\beta$ region, and the resulting titanium alloy ingot is processed directly into a titanium alloy component having a desired shape. The titanium alloy component thus manufactured has a satisfactory fatigue strength and is also excellent in machinability, and can be used for connecting rods, valves, retainers, etc. to be incorporated in the engine of an automobile.

16 Claims, 1 Drawing Sheet

MANUFACTURING TITANIUM ALLOY COMPONENT BY BETA FORMING

TECHNICAL FIELD

The present invention relates to a titanium alloy component, such as a connecting rod, valve, or retainer, and a method for manufacturing the same, and more particularly, to a method for manufacturing the titanium alloy component by directly hot-forging a titanium alloy material.

BACKGROUND ART

Conventionally, iron-based materials have been mainly used for connecting rods, valves, retainers and the like. However, the iron-based materials cannot be positively regarded as the satisfactory materials to meet the demands for lighter engines and higher engine speed because of relatively high specific gravity.

Recently, therefore, titanium alloys with lower specific gravity have started to be used as the materials for the connecting rods of some special automobiles, such as racing cars. Among these titanium alloys, one having a composition given by 6% Al- 4% V-Ti is generally used for the purpose.

In a case of manufacturing the aforesaid component by taking the advantage of a titanium alloy composed of aluminum of 6% and vanadium of 4%, after preparing the above composed titanium alloy, by subjecting an ingot to hot-forging, a product in a desired shape is obtained. And further, if necessary, after subjecting the obtained component to cut machining, it is processed to a finished product.

In general, if the hot forging is conducted at a higher temperature, then the deformability of the ingot material increases, and whereby its forging ability improves in proportion. In the case of the titanium alloy of the aforesaid composition, however, if the hot forging is conducted at a temperature in a $\beta$ region, which is higher than the temperature in the $(\alpha+\beta)$ region, the grain size in the resulting alloy texture is coarse, so that the toughness of the alloy is decreased. It is, therefore, common that the hot-forging is conducted the $(\alpha+\beta)$ region. For this reason, the impact value also becomes higher.

When conducting the hot forging in the $(\alpha+\beta)$ temperature region, however, it is required to control the entire temperatures of the surface and core portion of the ingot material within the $(\alpha+\beta)$ temperature region. The deformability of the titanium alloy of the aforesaid composition in this temperature region is not always high. Therefore, desirable forgability is not attained. In addition, desired machinability is also not attained. In order to industrially supply reliable products in bulk, it is required to maintain high quality of the forgings. However, in the light of the aforesaid reason, in forging, it is required to considerably and strictly control the forging process and further, there are economical problems due to the uncertainty of the workability.

In industrial production, it may be advisable to perform the hot forging in a high-deformability temperature region, e.g., the $\beta$ region. As mentioned above, however, the hot forging at a temperature in such a $\beta$ region temperature lowers the toughness of the titanium alloy component, so that it cannot be practically used in view of product quality.

An object of the present invention is to provide a titanium alloy component and a method for manufacturing the same, which is capable of being used in parts of an engine regardless of a slight lowering of toughness in a case of directly hot-forging an ingot of a titanium alloy at an $(\alpha+\beta)$ temperature region. A further object of the present invention is to provide a titanium alloy component having a fatigue strength of a equivalent level to a titanium alloy comprising 6% aluminum and 4% vanadium, which is hot forged at an $(\alpha+\beta)$ region, and in a case of where maintenance of fatigue strength with stress concentration depending upon a irregular shape is a significant factor.

Another object of the invention is to provide a titanium alloy component and a method for manufacturing the same, which includes higher machinability than a titanium alloy composed of aluminum of 6% and vanadium of 4%. A further object of the present invention is to provide a titanium alloy and a method for manufacturing the same, which are excellent in hot forging ability estimated by ease of forging, controlling temperatures and obtaining high quality forging products.

DISCLOSURE OF THE INVENTION

According to thee present invention, there is provided a method for manufacturing a titanium alloy component, which comprises preparing a titanium alloy composed of aluminum of 2 to 4% by weight, vanadium of 1.5 to 2.5% by weight, and titanium substantially for the remainder, and rough-forming and hot-forging the obtained titanium alloy into a desired shape at a temperature in a 62 region.

According to another aspect of the present invention, a method for manufacturing a titanium alloy component, which comprises preparing a titanium alloy composed of aluminum of 2 to 4% by weight, vanadium of 1.5 to 2.5% by weight, a rare earth element (hereinafter, referred to as REM) of 0.20 to 0.45% by weight, sulfur of 0.05 to 0.11% by weight, and titanium substantially for the remainder, the ratio of the REM content to the sulfur content preferably ranging from 3.8 to 4.2, and rough-forming and hot-forging the obtained titanium alloy into a desired shape at a temperature in a $\beta$ region.

The method of the present invention is applied in two kinds of titanium alloys, namely one of which is composed of aluminum of 2 to 4% by weight, vanadium of 1.5 to 2.5% by weight, and titanium substantially for the remainder, the other of which is composed of aluminum of 2 to 4% by weight, vanadium of 1.5 to 2.5% by weight, REM of 0.20 to 0.45% by weight, S of 0.05 to 0.11% by weight, and the ratio (REM/S) of the REM content to the S content preferably ranging from 3.8 to 4.2. In these two kinds of titanium alloys, machinability of the latter alloy can be improved by containing REM and S.

In a titanium alloy used in the present invention, aluminum is used as a stabilization element for titanium and also as an element for facilitating improvement of strength of the titanium alloy, and is contained in an amount thereof within a range of 2 to 4% by weight. If the aluminum content is less than 2% by weight, the foregoing effect cannot be obtained. If the aluminum content exceeds 4% by weight, lowering of machinability occurs. It is, therefore, preferable that the aluminum content is in a range of 2.5 to 3.5% by weight, and more preferably 2.75 to 3.25% by weight.

Vanadium is a $\beta$-stabilization element for the titanium and facilitates improvement of strength of titanium alloy. If the vanadium content is less than 1.5% by weight, the above mentioned effect cannot be obtained. And also, if its content exceeds 2.5% by weight, lowering of machinability occurs. Therefore, it is required that the vanadium content is set within a range of 1.5 to 2.5% by weight. Further, it is preferable that its content is in a range of 1.75 to 2.25% by weight, and more preferably 2.0 to 2.2% by weight.

In a case of preparing an alloy, the REM and S transfer to a stable compound by chemically bonding to each other. Whereby inclusions in a structure of obtained alloy are granulated, and toughness of the titanium alloy can be improved. Further, the REM and S are also elements for facilitating improvement of machinability of the titanium alloy.

It is preferable that elements such as Y, Ce and other lanthanide series are used as the REM, and further, it is preferred that these elements are used alone or two kinds or more of these are properly combined and used.

In this case, the composition is set so that the REM content ranges from 0.20 to 0.45% by weight, the S ranges from 0.05 to 0.11% by weight, and it is set so that a ratio of REM to S content (hereinafter, referred to as REM/S) may be ranged form 3.8 to 4.2.

In a case of where the REM and S contents are less than 0.20 and 0.05% by weight, respectively, the above mentioned machinability is not improved. Further, in a case of where their contents are more than 0.45 and 0.11% by weight, respectively, lowering of anticorrosion and strength of the obtained titanium alloy occurs.

Preferably, the REM content ranges from 0.25 to 0.40% by weight, and more preferably, from 0.30 to 0.42% by weight. The S content preferably ranges from 0.06 to 0.10% by weight, and more preferably, from 0.07 to 0.09% by weight.

Moreover, if the REM/S is deviated from the foregoing range, many cracks are generated on the titanium alloy during the hot-forging in the $\beta$ region. And further, since the REM and S except the aforesaid stable compound of the REM and S exist independently in the alloy structure, the machinability of the alloy lowers.

Preferably, the value of the REM/S ranges from 3.9 to 4.1, and more preferably, from 4.0 to 4.1.

The titanium alloy to be used in the present invention permits containing elements such as N, C, H, O, Fe and the like, as impurities. In this case, it is required that each of N, C, H, O, Fe is limited to 0.02% by weight or less, 0.02% by weight or less, 0.005% by weight or less, 0.3% by weight or less, 0.4% by weight or less, respectively.

The titanium alloy according to the present invention is prepared as follows. First, the individual ingredients for the above composition are introduced in predetermined quantities into a plasma progressive casting furnace (hereinafter, referred to as PPC) and are entirely melted therein. In this case, the PPC furnace is used because it can provide higher temperatures than any other furnaces.

When manufacturing the titanium alloy containing the REM and S, the REM and S are introduced in the adjusted form of spherical or angular particles with diameters of 0.3 to 2.5 mm into the furnace.

If the particle diameter is smaller than 0.3 mm, a large amount of the REM and S gasify and dissipate outside the furnace in a process of melting the ingredients in the PPC furnace, and further, their contents in the obtained titanium alloy are reduced. For these reasons, the above mentioned effect can not be obtained. Moreover, if the particle diameter is greater than 2.5 mm, the ingredients are not melted completely in the PPC furnace, as the result, some remain unmelted in the furnace. Thus, defects measured by an ultrasonic test generate in the texture of the finally obtained titanium alloy.

The ingot obtained in the PPC furnace is not one obtained of which all of ingredients are uniformly melted with one another, but only is one obtained of partial melting in the boundary regions between the ingredients. For this reason, the ingot obtained in the PPC furnace is further transferred to a vacuum melting furnace, and then, it is entirely melted therein so that the ingredients are homogenized.

The titanium alloy of desired composition manufactured in this manner is further cast into an ingot shape like a bar.

After that, the ingot is rough-formed into a shape closely resembling a desired shape, and is then hot-forged at a stroke into the shape of predetermined component.

In all cases, the rough-forming and hot forging are conducted at the $\beta$ region temperature for the aimed titanium alloy. The temperature at the boundary between the $\beta$ and the $(\alpha+\beta)$ regions varies depending on the composition of the titanium alloy. The temperature of the titanium alloy according to the present invention ranges from 920° to 930° C. (the temperature of 980° C. in the titanium alloy composed of aluminum of 6% and vanadium of 4%). According to the present invention, therefore, the rough forming and hot forging may be effected at any temperature in a range of the above temperature or more. It is a not matter of course that this temperature is lower than the temperature at which the titanium alloy melts.

Thus, the temperature control during the forging process is much easier than a case of the hot forging in the $(\alpha+\beta)$ regions. Forging, rolling, or any other suitable method may be used for the rough forming.

The material obtained by the rough forming may be hot-forged by the conventional buffer and blocker process, swaging or roll forging method. Usually, the reduction ratio for each cycle of hot forging operation, which is not restricted in particular, is expected to range from 40 to 80%.

Thus, the material hot-forged into the shape of the desired component, such as a connecting rod, valve, or retainer, is air-cooled as it is. The resulting structure can be subjected directly to surface finish processing, such as debarring, without requiring any heat treatment, whereupon it can be incorporated as a part in the engine of an automobile.

EMBODIMENT

After each of elements such as Al, V or the like was put into a PPC furnace and was melted, the obtained ingot was transferred to a vacuum furnace and then was perfectly melted therein. An further, after cooling a fused liquid thereof, two ingots comprising elements as shown in Table 1 were made.

Average particle diameters of REM and S were 1.5 mm and 0.2 mm, respectively.

TABLE 1

| | Alloy Composition (wt %) | | | | | | | | | | |
|---|---|---|---|---|---|---|---|---|---|---|---|
| | N | C | H | Fe | O | Al | V | REM | S | Ti | REM/S |
| Sample 1 | 0.010 | 0.013 | 0.0032 | 0.20 | 0.15 | 3.05 | 2.04 | 0.32 | 0.08 | bal | 4.0 |
| Sample 2 | 0.012 | 0.015 | 0.0028 | 0.18 | 0.17 | 3.00 | 2.02 | — | — | bal | — |

These samples were subjected to a tensile test at various temperature, a reduction in area thereof was measured when the samples were broken. For comparison, the same test was conducted for a Ti alloy containing aluminum of 6% and vanadium of 4% as a control 1. The results of the test were as shown in FIG. 1, in which △, ○, and ● marks present the cases of Sample 1, Sample 2 and the control 1, respectively.

Figure 1:
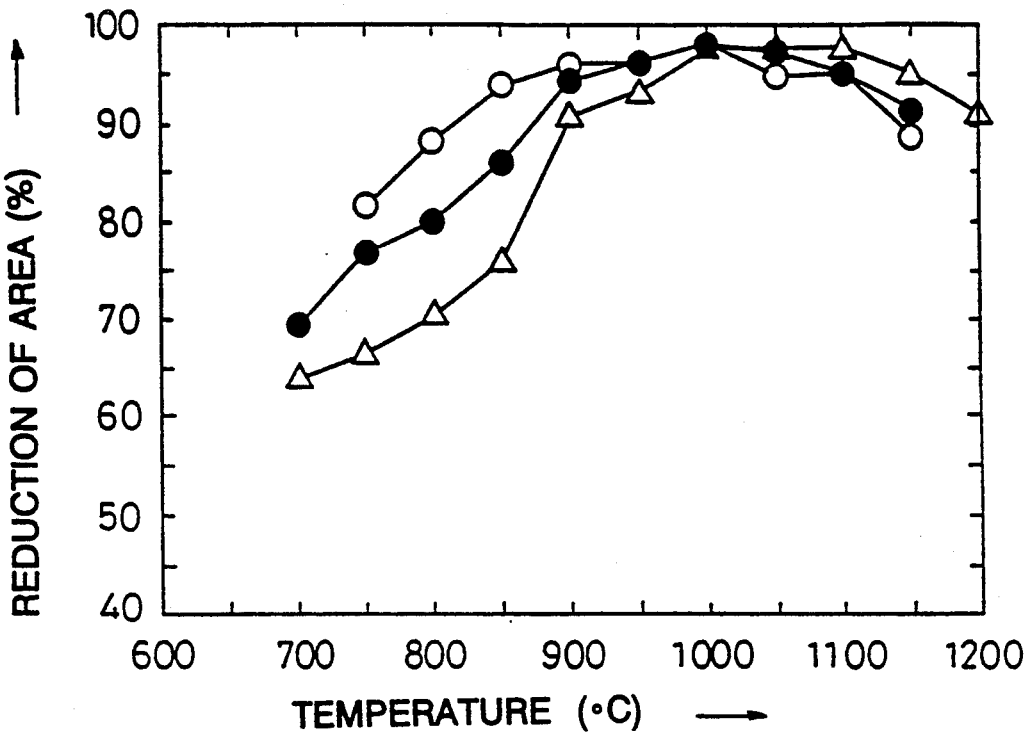
FIG. 1 is a graph showing a reduction of area in an ingot of a titanium alloy at various temperatures when the ingot is broken down by a tensile testing at various temperatures.

As seen form FIG. 1, when reaching the $\beta$ region temperature (the Samples 1 and 2 are 930° C. or more, the control 1 is 980° C. or more), the Samples 1 and 2 and the control 1 exhibited very high deformability. Namely, the above Ti alloy had high hot forging properties in the $\beta$ region temperature.

So, Samples 1 and 2 and the control 1 were hot-forged with reduction ratio of 70% at the temperatures shown in Table 2. The obtained forgings were measured for tensile strength. Further, the forgings were measured for smooth fatigue limit and notched fatigue limit by the Ono's rotational flexural fatigue test. The results of these tests were collectively shown in Table 2.

TABLE 2

| | Forging Temperature (°C.) | | Tensile strength (kgf/mm$^2$) | Fatigue limit of smooth specimens (kgf/mm$^2$) | Fatigue limit of notched specimens (kgf/mm$^2$) |
|---|---|---|---|---|---|
| Sample 1 | 1050 | $\beta$ region | 83.0 | 48.0 | 29.0 |
| | 900 | $\alpha + \beta$ region | 83.0 | 47.5 | 28.5 |
| Sample 2 | 1050 | $\beta$ region | 82.5 | 48.0 | 29.0 |
| | 900 | $\alpha + \beta$ region | 82.0 | 48.0 | 28.5 |
| Control 1 | 1050 | $\beta$ region | 107.0 | 59.0 | 31.5 |
| | 950 | $\alpha + \beta$ region | 106.0 | 59.0 | 27.5 |

As seen from the results shown in Table 2, the forgings obtained by the method of the present invention have tensile strength and fatigue limit equal to that of a forging obtained in the $(\alpha+\beta)$ region.

As compared with a forging comprising Ti alloy containing aluminum of 6% and vanadium of 4%, although the fatigue limit of smooth specimens was lower than that of the forging, the fatigue limit of the notched specimens was approximately equal to that of the forging. Accordingly, it can be judged that notch sensitivity of the forging according to the present invention had the same level with that of the above forging comprising a Ti alloy.

Next, the Ti alloy comprising aluminum of 6% and vanadium of 4% which blended amounts of REM and S the same as a case of Sample 1 was melted and manufactured, an obtained ingot was hot-forged in the $\beta$ region with reduction ratio of 70% as a control 2.

Figure 2:
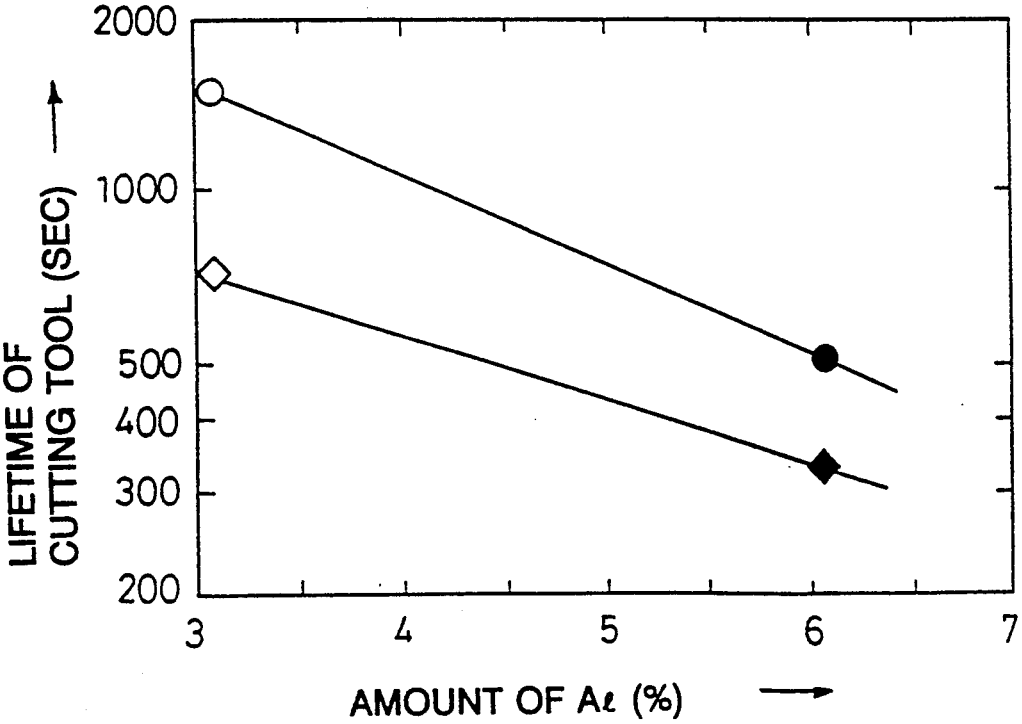
FIG. 2 is a graph showing machinability of $\beta$-region forgings of a titanium alloy.

With respect to a forging according to Sample 1 in the $\beta$ region, a forging according to Sample 2 in the $\beta$ region, controls 1 and 2, machinability in each of the forgings was examined based on the following conditions: cutting tool: carbide K 10, feed: 0.15 mm/rev, depth of cut: 1.5 mm, cutting speed: 60 m/min, cutting oil: none The results were shown in FIG. 2, in which ○, ◇, ● and ◇ marks represent the cases of Sample 1, Sample 2, control 2 and control 1, respectively.

As seen from FIG. 2, according to a Ti alloy component of the present invention, even a component, namely Sample 2 which was not added free-machining elements such as REM and S, machinability thereof were superior to that of the Ti alloy component (control 2) comprising aluminum of 6% and vanadium of 4% which added the free-machining elements. Accordingly, Sample 2 to which the free-machining of elements are added has very excellent machinability.

Thus, according to the method for manufacturing the Ti alloy component of the present invention, since the alloy component was hot-forged in the $\beta$ region only, as compared with a case of where it was hot-forged in the $(\alpha+\beta)$ region such as conventional, it is easy to control temperature in the forging process. And further, although hot-forging was carried out in the $\beta$ region, the fatigue limit and particular to the fatigue limit of notched specimens were equal to these of a Ti alloy component comprising aluminum of 6% and vanadium of 4% and included notch sensitivity which is an equivalent level to the Ti alloy. In addition, it is excellent to machinability. The utility value thereof was, therefore, extremely great in industrial fields.

POSSIBILITY FOR UTILIZING IN INDUSTRIAL FIELDS

The titanium alloy component of the present invention can be used in a connecting rod, a valve, a retainer and the like for an engine of automobiles.

We claim:

1. A method for manufacturing a titanium alloy component, comprising:
   (a) preparing a titanium alloy comprising 2 to 4% by weight of aluminum, 1.5 to 2.5% by weight of vanadium, and the remainder being substantially titanium;
   (b) heating said titanium alloy to a temperature in a $\beta$ region to subject said titanium alloy to rough-forming in said temperature region; and
   (c) hot-forging the resulting material from step (b) in said $\beta$ temperature region only.

2. The method according to claim 1, wherein said titanium alloy further comprises 0.20 to 0.45% by weight of a rare earth element and 0.05 to 0.11% by weight of sulfur.

3. The method according to claim 1, wherein said hot forging is carried out by a buffer and blocker process.

4. The method according to claim 1, wherein said hot forging is carried out by a swaging method.

5. The method according to claim 1, wherein said hot forging is carried out by a roll forging method.

6. The method according to claim 1, wherein the aluminum is in an amount of 2.75 to 3.25 weight %.

7. The method according to claim 1, wherein said alloy consists essentially of:

0.010 weight % N,
0.013 weight % C,
0.0032 weight % H,
0.20 weight % Fe,
0.15 weight % O,
3.05 weight % Al,
2.04 weight % V,
0.32 weight % rare earth element,
0.08 weight % S, and the balance being Ti, and the ratio of rare earth element to sulfur being 4.0.

8. The method according to claim 1, wherein said alloy consists essentially of:

0.012 weight % N,
0.015 weigh % C,
0.0028 weight % H,
0.18 weight % Fe,
0.17 weight % O,
3.00 weight % Al,
2.02 weight % V and the balance being Ti.

9. The method according to claim 1, wherein the temperature at which the forging is carried out within beta temperature region between 900° to 1050° C.

10. The method according to claim 2, wherein the ratio of the rare earth element content to the sulfur content of said titanium alloy is 3.8 to 4.2.

11. The method according to claim 2 or 10, wherein the rare earth element and the sulfur have particle diameters of 0.3 to 2.5 mm.

12. The method according to claim 6, wherein the vanadium is in an amount of 1.75 to 2.25 weight %.

13. The method according to claim 6, wherein the vanadium is in an amount of 2.0 to 2.2 weight %.

14. The method according to claim 13, wherein the titanium alloy further comprises 0.25 to 0.40 weight % of a rear earth element selected from the group consisting of Ce and Y and 0.06 to 0.10 weight % sulfur and the ratio of the rare earth to the sulfur is 3.9 to 4.1.

15. The method according to claim 14, wherein the rare earth element is in an amount of 0.30 to 0.42 weight %, the sulfur is in an amount of 0.07 to 0.09 weight % and the ratio of the rear earth element to the sulfur is 4.0 to 4.1.

16. A method for manufacturing a titanium alloy component, consisting essentially of:

(a) preparing a titanium alloy consisting essentially of 2 to 4% by weight of aluminum and 1.5 to 2.5% by weight of vanadium, and optionally 0.20 to 0.45% by weight of a rear earth element and 0.05 to 0.11% by weight of sulfur and the remainder being substantially titanium;

(b) heating said titanium alloy to a temperature in a $\beta$ region to subject said titanium alloy to rough-forming in said temperature region; and (c) hot-forging thee resulting material from step (b) in said $\beta$ temperature region at a temperature of 900° to 1050° C.

* * * * *